US005852906A

United States Patent [19]

Kuban

[11] Patent Number: 5,852,906

[45] Date of Patent: Dec. 29, 1998

[54] INTERNAL-WALL DRAIN SYSTEM

[76] Inventor: Eugene J. Kuban, 231 Hamtom Rd., Eighty-Four, Pa. 15330

[21] Appl. No.: 908,653

[22] Filed: Aug. 7, 1997

[51] Int. Cl.[6] ..... B02D 19/00; B02B 11/00

[52] U.S. Cl. ..... 52/302.1; 52/302.4; 52/169.5; 52/607; 405/45; 405/43

[58] Field of Search ..... 52/302.1, 302.3, 52/302.4, 169.5, 431, 293.2, 604, 605, 606, 607, 294; 405/43, 45, 50, 36–38

[56] References Cited

U.S. PATENT DOCUMENTS

| | | | |
|---|---|---|---|
| 1,224,699 | 5/1917 | Tucker | 52/169.5 |
| 1,524,146 | 1/1925 | Murray . | |
| 1,670,095 | 5/1928 | Boes | 52/302.4 X |
| 1,900,457 | 3/1933 | Miller | 52/302.4 |
| 2,138,724 | 11/1938 | Brozek . | |
| 2,147,035 | 2/1939 | Henderson | 52/302.4 X |
| 2,530,940 | 11/1950 | Dahlin . | |
| 2,703,487 | 9/1955 | Ossoinack . | |
| 2,911,818 | 11/1959 | Smith . | |
| 5,074,708 | 12/1991 | McCann Sr. | 405/45 X |
| 5,100,258 | 3/1992 | Van Wagoner | 405/45 |
| 5,248,218 | 9/1993 | Belcher | 405/43 |
| 5,277,003 | 1/1994 | Myers | 52/169.5 |
| 5,444,950 | 8/1995 | Kelly et al. | 52/169.5 |
| 5,474,400 | 12/1995 | Kliefoth . | |
| 5,586,416 | 12/1996 | Hess, III et al. | 52/169.5 |

FOREIGN PATENT DOCUMENTS

| | | |
|---|---|---|
| 19434 | 9/1956 | Germany . |
| 980967 | 1/1965 | United Kingdom . |

*Primary Examiner*—Carl D. Friedman
*Assistant Examiner*—Winnie S. Yip
*Attorney, Agent, or Firm*—Clifford A. Poff

[57] ABSTRACT

A system is disclosed for draining water from a location external to a structure, the system located internally of structural members forming a part of the structure. The system includes block members having internal openings for receiving a length of perforated pipe and cavities forming reservoirs for pooling of water and transfer into the pipe via the perforations.

9 Claims, 3 Drawing Sheets

INTERNAL-WALL DRAIN SYSTEM

BACKGROUND OF THE INVENTION

1. Field of the Invention

The present invention relates generally to a water drainage system, and more particularly to a drainage system for a structure which is located internally of the structural members forming part of the structure for transfer of water through the structure from a location exterior of the structure.

2. Description of the Prior Art

Structures which have subterranean portions, such as home basement walls, are often subject to water pressure on the exterior face of such a wall after heavy rains or melting snow results in ground saturation. The water pressure often becomes large enough that the integrity of the structure weakens to the extent that water is forced through the structure and into the interior of the structure where damage results. Prior art responses to the threat of excess water pressure include the provision of a protective layer, such as tar and/or plastic, on the exterior surface of the structure. Similarly, a sealing layer is often painted onto the interior face of such a wall to prevent water which has already breached the exterior face of the structure from passing completely through the structure to the structure's interior. These treatments of the problem do nothing to reduce the pressure which such water is applying and over time will deteriorate, if not maintained periodically, to the point that water will find a pathway through the structure.

It is also well known in the prior art to provide for drainage of water around the exterior of a subterraneous portion of a structure by the installation of a french drain system, which generally involves the subterraneous formation of a bed of gravel adjacent the exterior face of the wall usually upon a sloping earth base to allow for the free flow of subsurface water in the bed of gravel away from the wall face. In other instances, a length of perforated polyvinyl chloride (PVC) pipe is embedded in the bed of gravel to direct subsurface water. The known french drain systems depend on the sloping earth base to provide for the drainage flow through the system. The installation of such a system can be laborious, particularly in the typical situation where installation is made to an existing dwelling. In such a situation, the installation requires the digging of a properly sloped channel, placement of gravel and/or pipe, and restoration of topsoil together with sodding or seeding of the lawn surface. Additionally, while such a system will remove a portion of the water against the exterior face of a structure in a saturated condition, typically it will not remove all of the water against the exterior. Since the water will drain to the level of the lowest holes along the length of pipe, the result is that a certain amount of water may remain against the exterior of the structure and eventually work its way to the building interior.

It is therefore an object of the present invention to provide a drainage system for a structure internal to the structural members forming the structure which prevents water external to the structure from building up pressure against the structure and therefore eliminates the need for application of a protective layer on the exterior of the structure.

It is further an object of the present invention to provide a drainage system for a structure internal to the structural members forming the structure which saves labor and material costs as compared with external prior art drainage systems by eliminating the need for an aggregate layer to protect drain pipe openings from becoming obstructed by the surrounding earth since the drain pipe provided by the present invention is protected from the earth by the structure itself.

It is a further object of the present invention to provide a drainage system for a structure internal to the structural members forming the structure which improves over external prior art drainage systems by eliminating the need to control the slope of the drain pipe.

It is still a further object of the present invention to provide a drainage system for a structure internal to the structural members forming the structure which is readily installed during the construction process thereby saving labor costs compared with prior art external drainage systems.

SUMMARY OF THE INVENTION

In accordance with the present invention there is provided a drainage system for a structure. The drainage system includes a substrate, such as a footer, having an upper surface. The system further includes a plurality of blocks at least partially supported on the upper surface of the substrate each having at least one internal cavity bounded by side walls and partition walls and further having at least one opening in the walls creating a pathway through the block, the blocks arranged in a course such that at least a portion of the pathway of each block opposes at least a portion of the pathway of an adjacent block thereby creating a continuous pathway through the course of blocks, each of the blocks further having a sealable surface for creating a reservoir area between the block and the upper surface of the substrate. The system further including piping extending through the pathways in the blocks having an internal cavity and a porosity sufficient to allow the passage of water into the internal cavity via the reservoir area.

DETAILED DESCRIPTION OF THE PREFERRED EMBODIMENT

In a typical prior art external french drain system, well known in the art, there is included a length of pipe, most commonly made of polyvinyl chloride (pvc) and approximately 4 inches in diameter, the pipe having been perforated by including spaced apart openings to allow for the passage of water through the wall of the pipe to the pipe interior. The pipe is placed in trench which has been dug at a slope to provide for a flow as water enters the pipe under saturated conditions. Although such a system may be installed with new construction, it is most commonly installed after a drainage problem is discovered. Once the tube has been positioned, a layer of gravel is placed above the pipe to help establish a flow path towards the pipe as well as prevent the surrounding earth from entering and clogging the pipe openings. Even with such a system, it is typical that there will be a certain level of water that cannot be removed and which will place pressure against the wall resulting in potential seepage into and through the block wall to the interior of the structure.

Figure 1A:
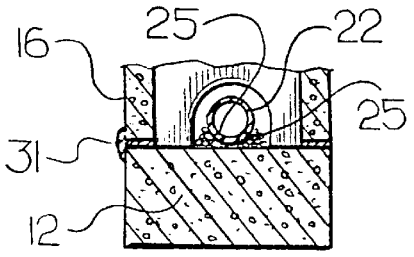
FIG. 1A is a sectional view of the pipe of the drain system of FIG. 1 Waken at the location of openings in the pipe shown supported on the footer.
Figure 1:
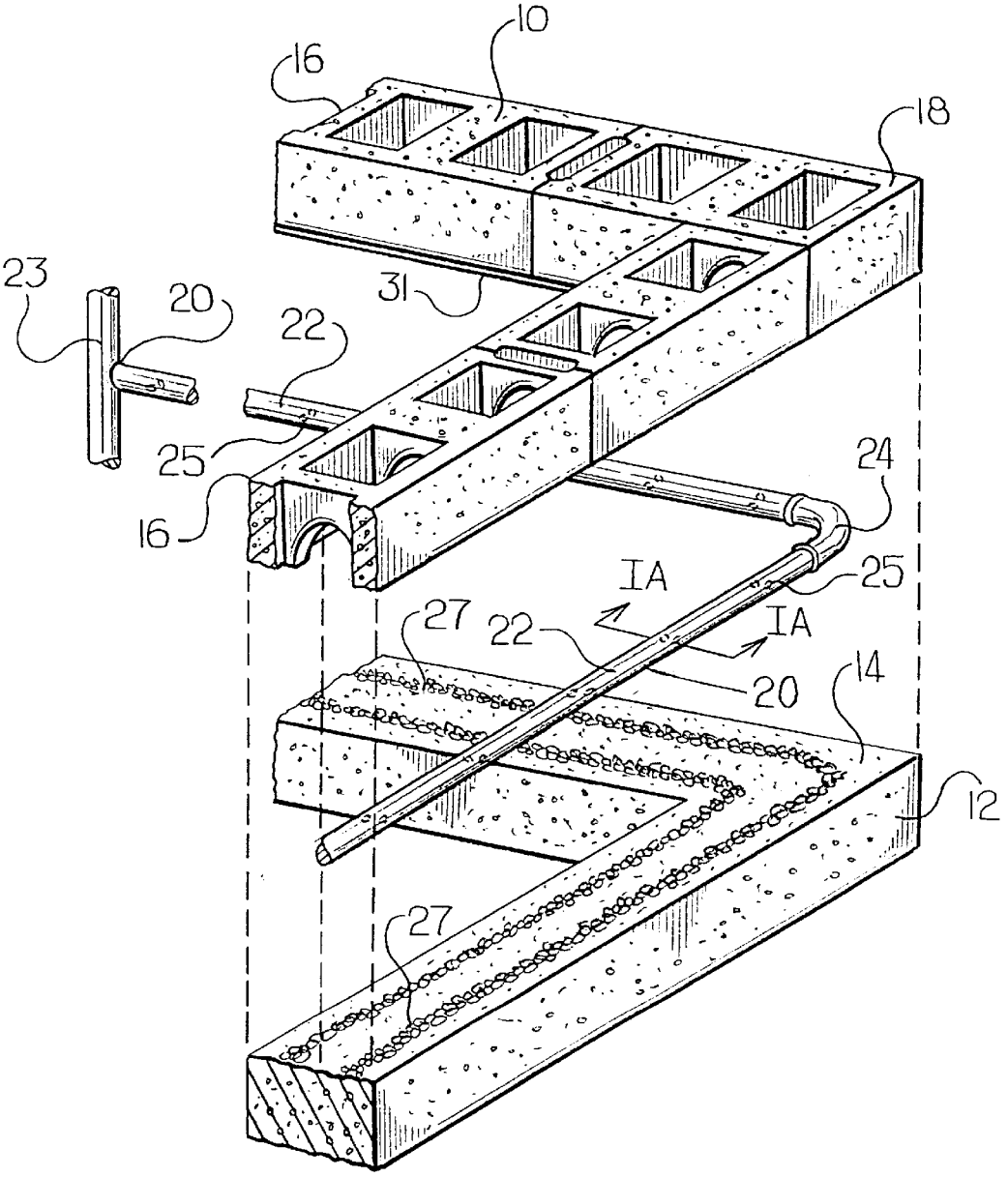
FIG. 1 is an exploded perspective view of a portion of a drain system according to the present invention.

Referring to FIG. 1, an exploded perspective of a portion of an internal wall drain system according to the present invention is shown. The system includes a first course 10 of blocks forming the lower part of a structure, such as a basement wall of a typical house which is supported on a substrate, such as footer 12 having upper surface 14. The first block course 10 includes linear pathway blocks 16 which are arranged to form wall segments as shown and bend-pathway block 18 which connects the wall segments and forms part of a corner of the structure. The system also includes pipe 20 which has linear segments 22 joined together by pipe elbow 24. The pipe 20 is perforated by openings 25 at spaced apart locations along the lower half of the positioned pipe, the locations of the openings shown by dashed lines in the perspective view of FIG. 1. Pipe 20 is shown extending to a tee connection with drainage pipe 23, which may be part of the drainage system for the structure, for example. The pipe is located in a space between the first block course 10 and the upper surface 14 of footer 12 in openings in the blocks, which will be described further. The drain system of FIG. 1 also includes gravel 27 which is placed around the pipe once it has been located between the first block course and the footer.

Referring to FIG. 1A, there is shown a sectional view through one of the linear segments 22 of pipe 20 at a location having the openings 25. As seen, the pipe is positioned so that the openings are located along the lowermost portion of the pipe in relation to the footer on which it is located.

Figure 2:
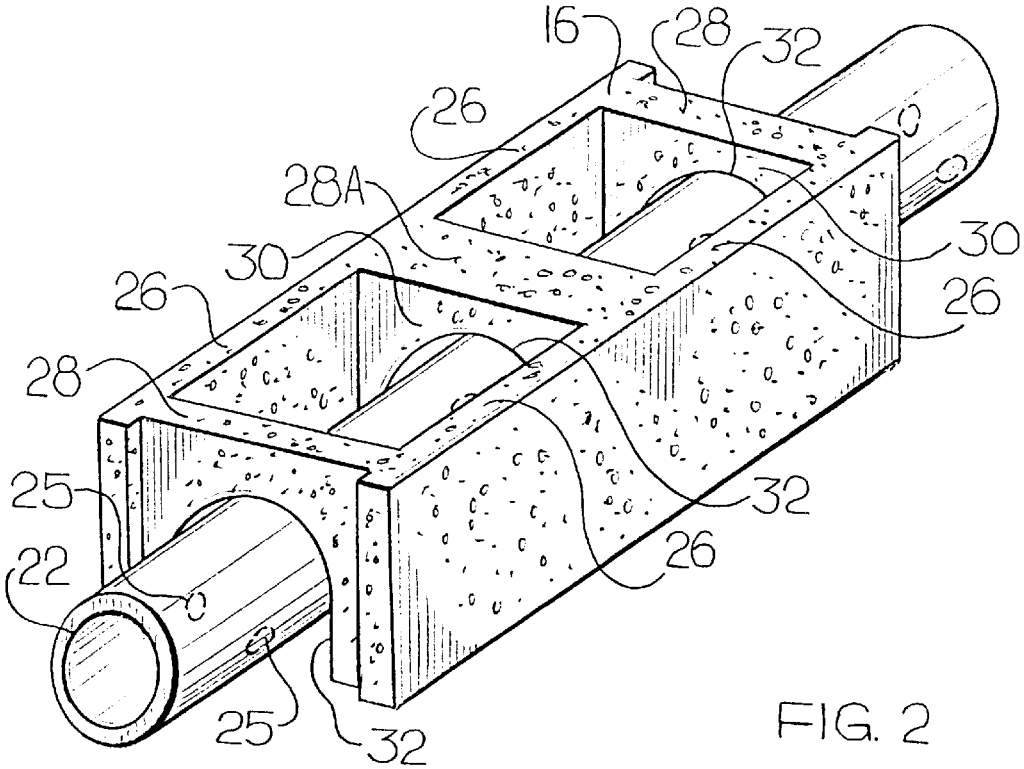
FIG. 2 is a perspective view of a typical block of the drain system of FIG. 1 and associated length of pipe in a linear section of the drain system.

Turning to FIG. 2, the construction of a linear pathway block 16 and associated linear pipe segment 22 is shown. The block is constructed similarly to typical concrete building block and has side walls 26 and transverse partition walls 28, including an internal partition wall 28A, surrounding two cavities 30. The cavities 30 will form reservoir areas within the interior of the block for the collection of water which may enter the block through the exterior of the structure. As was seen in FIG. 1, the block is part of a first course of blocks in the wall supported on the footer of the building. Each of partition walls 28 and internal partition wall 28A has an opening 32 extending from the lower edge of the block thereby creating aligned pathways in walls 28 and 28A for linear pipe segment 22 of pipe 20 to extend. The pipe openings 25 at spaced apart location along the length of pipe segment 22 will receive water to the interior of the pipe as it pools in the reservoir area between the block and the footer. The locations of openings 25 are most preferably located adjacent to the partition walls 28 as shown to help protect the openings from mortar or other debris which may inadvertently drop into the cavities 30 during the construction process prior to the placement of the gravel 27 around the pipe. Since the cavities 30 will function as reservoirs, it is important that boundary between the footer and the interior edge of the block which is adjacent to the footer be sealable, such as by placement of mortar 31, as seen in FIG. 1, between the footer and the interior edge, to retain a pool of water within the reservoir area to the level of the openings 25 in pipe segment 22. Although the size of the pipe and the corresponding openings 32 may vary depending on conditions or design preference, it has been found that the drain pipe may be as small as approximately 2 inches in diameter as part of a typical home construction. Each of the blocks in a wall segment will be similar in construction to the linear pathway block 16 shown in FIG. 2, with the exception of the blocks forming parts of the corners of the structure which is shown in FIG. 3.

Figure 3:
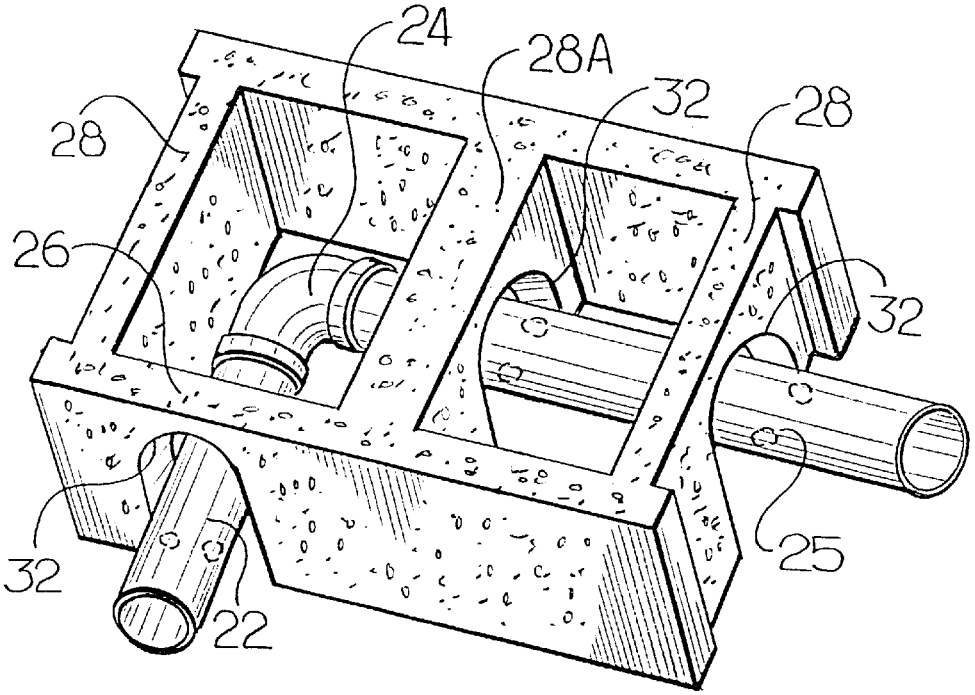
FIG. 3 is a perspective view of a typical block of the drain system of FIG. 1 and associated length of pipe forming a part of the corner the structure.

Referring to FIG. 3, the construction of a block 18 forming the corner of the building wall according to the present invention is shown. The construction is similar to the block 16 of FIG. 2 which forms a part of the linear wall section with the addition of a pipe elbow 24 to provide the perpendicular redirection of flow which is desirable at the corner of the wall. The construction of the corner block 18 also requires that one of the openings 32 forming the pathway through the block be located in a side wall 26, as seen in FIG. 3, as opposed to one of the partition walls 28. Additionally, the block forming the linear sections of wall which extend from the corner block will be oriented parallel with the corner block for one of the linear sections and perpendicularly with the corner block for the other linear section as was seen in the block segment 10 of FIG. 1.

The drain system of the present invention will require less gravel than a conventional french drain system which generally requires a larger diameter pipe and which requires the gravel layer to provide a barrier between the surrounding earth and the pipe to ensure flow of water into the openings of the pipe. In contrast, because the pipe of the present invention is located within the course of blocks there is no requirement for a gravel layer to provide a barrier between the pipe and surrounding earth, although an amount of gravel 27 will help to secure positioning of the pipe as well as protecting the openings 25 from debris which may be located within the course of blocks 10.

Another distinct advantage of the drain system of the present invention is that control over the slope of the piping is not required, thereby greatly simplifying the construction process in contrast to the typical external french drain system of the prior art. Although it is expected that a certain amount of water may collect toward the bottom of the block below the level of the openings 25 in pipe 20, the openings in the pipe will prevent the generation of any appreciable amount of water within the block thereby limiting any pressure against the interior side of the block.

Figure 4:
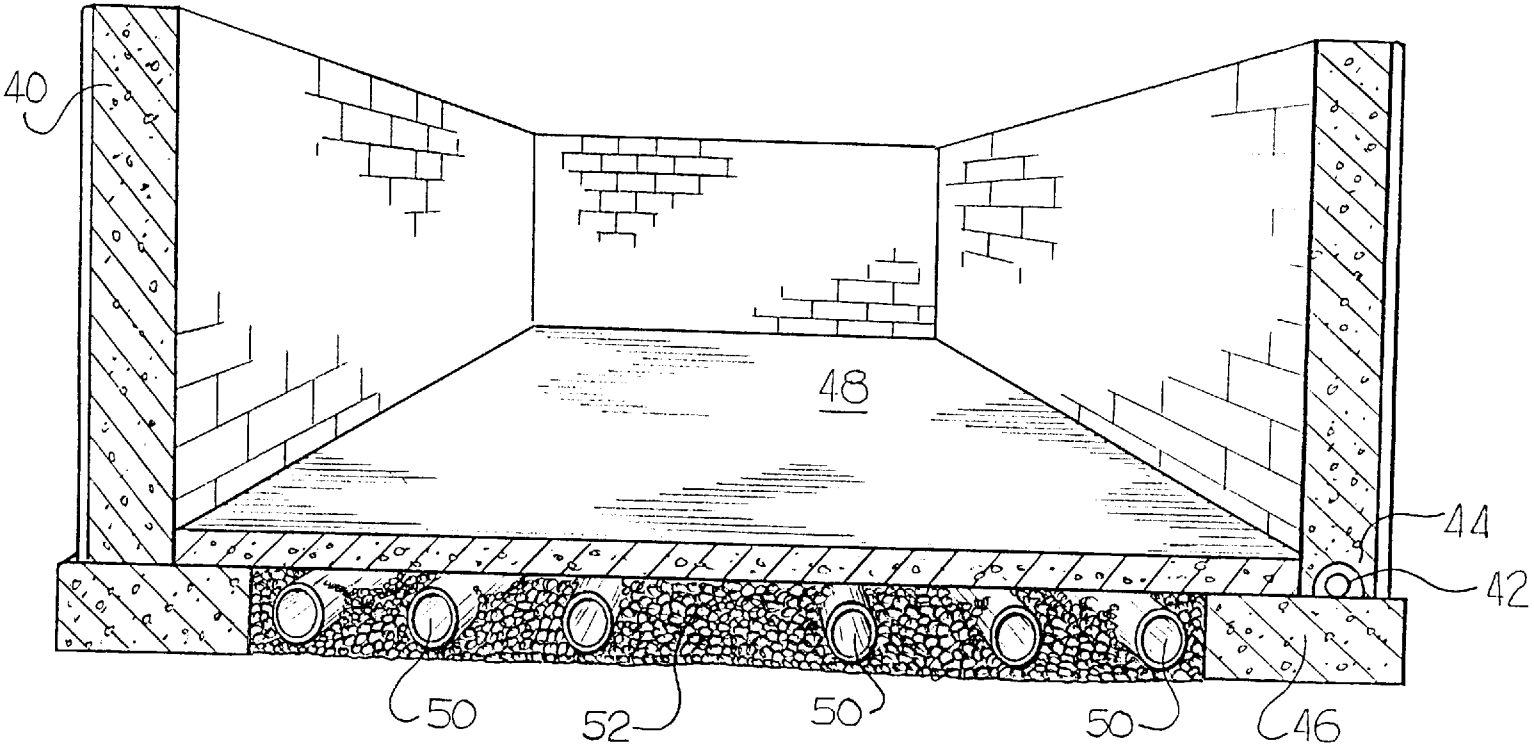
FIG. 4 is a sectional illustration of a structure incorporating the internal wall drain system of FIG. 1 through 3 in combination with a hydrostatic drain system located beneath the floor slab of the structure.

Turning to FIG. 4, there is shown a structure 40 having an internal wall drain system 42 according to the present invention located within the first course of blocks 44 atop a footer 46. As seen, the footer also supports the edges of a floor slab 48, extending between the first course of blocks 44. The internal wall drain of the present invention, as well as the external french drain systems of the prior art, are designed to remove ground water coming in contact with the block wall of the structure, that is, above the level of the footer. However, even with removal of ground water from the level of the walls of the structure, either from externally or internally of the structure wall, there will in some situations exist ground water conditions which could place hydrostatic pressure on floor slab 48 from beneath the floor slab.

The construction shown beneath slab 48 in FIG. 4 will alleviate hydrostatic pressure conditions. A series of spaced apart lengths of perforated pipe 50 are positioned within a gravel bed 52 beneath floor slab 48. The upwardly flowing water will be directed into the perforated piping 50 which may then be directed to a drainage system for the structure. The combination of the internal wall drain system with the drain system located beneath the floor slab, as seen in FIG.

4, would therefore alleviate both hydrostatic pressure beneath the slab as well as water pressure against the walls of the structure.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim:

1. A drainage system for a structure, the system including:

(a) a substrate having an upper surface;

(b) a plurality of blocks at least partially supported on the upper surface of the substrate each having at least one internal cavity bounded by side walls and partition walls and further having at least one opening in said walls creating a pathway through the block, the blocks arranged in a course such that at least a portion of the pathway of each block opposes at least a portion of the pathway of an adjacent block thereby creating a continuous pathway through the course of blocks, each of the blocks further having a sealable surface for creating a reservoir area between the block and the upper surface of the substrate; and (c) piping extending through the pathways in said blocks, said piping having an internal cavity and a porosity sufficient to allow the passage of water into the internal cavity of said piping via the reservoir area.

2. The drainage system according to claim 1, wherein the blocks are composed at least in part of aggregate in a cement binder.

3. The drainage system according to claim 1, wherein the porosity of said piping is provided by openings at spaced apart locations along said piping.

4. The drainage system according to claim 1, wherein the substrate is a footer on which the structure is supported and wherein said blocks form at least a portion of said structure.

5. The drainage system according to claim 3, further including a layer of aggregate surrounding at least a portion of said piping adjacent to said openings, the aggregate of a size sufficient to prevent the passage of substantially all of the aggregate through the openings in said piping.

6. The drainage system according to claim 4, wherein said piping extends to a connection with a drain pipe.

7. The drainage system according to claim 3 wherein the at least one opening in said piping at spaced apart locations is located adjacent to one of the openings in said side walls.

8. The drainage system according to claim 1, further including a water impervious seal breaching the sealable surface of the block and the upper surface of the substrate.

9. The drainage system according to claim 1, wherein the substrate is a footer and the arrangement of blocks forms at least a part of a plurality of structure walls supported atop the footer, the structure further including a floor slab extending between the structure walls, and wherein the drainage system further includes at least one length of perforated pipe positioned in a gravel bed located beneath the floor slab for conveying hydrostatic ground water upwardly directed at the floor slab.

* * * * *